US005249541A

United States Patent [19]

Sato et al.

[11] Patent Number: 5,249,541

[45] Date of Patent: Oct. 5, 1993

[54] FEED REGULATOR OF A SEWING MACHINE

[75] Inventors: Shuichi Sato; Yoshiharu Kobayashi, both of Tochigi, Japan

[73] Assignee: The Singer Company N.V., Curacao, Netherlands

[21] Appl. No.: 823,098

[22] Filed: Jan. 21, 1992

[30] Foreign Application Priority Data

Feb. 26, 1991 [JP] Japan ..... 3-053791

[51] Int. Cl.[5] ..... D05B 27/22

[52] U.S. Cl. ..... 112/316; 112/317

[58] Field of Search ..... 112/316, 303, 314, 315, 112/317

[56] References Cited

U.S. PATENT DOCUMENTS 4,183,314 1/1980 Sato ..... 112/317 X 4,476,795 10/1984 Vollmar ..... 112/316

4,732,095 3/1988 Saito et al. ..... 112/315 X

*Primary Examiner*—Clifford D. Crowder

*Assistant Examiner*—Paul C. Lewis

[57] ABSTRACT

A feed regulator of a sewing machine capable of varying a seam length at the stitching operation employs a first driving device for swingably driving a feed regulating table by way of a link mechanism so that a feed dog can switch the feed direction, whereby a reverse stitching operation can be performed in the same way as the conventional feed regulator. The feed regulator also employs a link mechanism having one surface for retaining the projection of the link member having a slit, one surface of which can retain the projection of the link mechanism, and a second driving device for driving the link member, whereby the reverse stitching operation can be performed by second driving device in the arbitrary seam length.

3 Claims, 4 Drawing Sheets

FEED REGULATOR OF A SEWING MACHINE

BACKGROUND OF THE INVENTION

1. Field of the Invention

The present invention relates to a feed regulator of a sewing machine which can change a seam length of a cloth at the time of stitching operation.

It is hitherto known that a sewing machine is provided with a reverse stitching mechanism as a conventional cloth feed regulator of the sewing machine (hereinafter referred to as feed regulator). The reverse stitching mechanism stitches the cloth partly as the feeding direction of the cloth to be stitched (hereinafter referred to as stitching cloth) is reversed for preventing fraying of a thread at the portion where the cloth is stitched first and last. The conventional reversing stitching is, in the reverse stitching mechanism as illustrated in FIG. 5, performed by an operator by stepping on a reverse stitching lever 101, thereby turning a feed regulating cam 102 so that an operating direction of a feed dog 103 is switched over. In an automatic reverse stitching mechanism, the feed regulating cam 102 is turned by operating a button, not shown. Designated at 104 is a feed regulating stud for controlling an inclining position of the feed regulating cam 102.

Seam length of the stitching cloth made by the conventional reverse stitching mechanism can not be varied since it is determined by a shape of a cam surface of the feed regulating cam 102 and is generally set to be the same as the seam length when the cloth is stitched by a forwarding stitching operation.

However, the cloth feed regulator of the sewing machine provided with the conventional reverse stitching mechanism has a single reverse stitching mechanism for performing the reverse stitching operation so that the seam length in the reverse stitching operation is not varied. As a result, the reverse stitching operation can be performed at the predetermined single seam length but cannot be performed at a seam length combining the predetermined single seam length with a seam length which is different from the predetermined single seam length. Although the operator can regulate a step rate of the feed reversing lever to keep the step position to the middle position in the reverse stitching mechanism provided with the reverse stitching lever, thereby performing the reverse stitching operation in the different seam length, the step rate is unstable and the operator must be experienced to obtain uniform seam pitches or lengths (hereinafter referred to as seam length).

For example, when stitching dart portions at a stitching starting position of the cloth BTS and stitching end position BTE of the cloth to prevent swelling of a stitching cloth 105 in FIG. 6, if the operator performs the reverse stitching while stepping fully on the reverse stitching lever, the stitching cloth is liable to swell. To prevent such swelling, the cloth is stitched at short seam length ST at the both ends BTS and BTE while the stepping rate of the reverse stitching lever is kept at the middle position as illustrated in FIG. 7.

In case of stitching a fastener on the cloth as illustrated in FIG. 8, if the short side S of the fastener is stitched at the same seam length as the long side L thereof, the stitching strength thereof is weak at the short side S. Accordingly, the fastener is repeatedly stitched as denoted BS in FIG. 8. As a result, it is necessary to step the reverse stitching lever frequently, which creates a troublesome operation.

The present invention is made to overcome the drawbacks of the conventional cloth feed regulating mechanism.

A feed regulator of a sewing machine according to a first aspect of the present invention comprises a first driving means for swingably driving a feed regulating table by way of a link mechanism and a feed dog for switching the feed operating direction. The feed regulator of a sewing machine further comprises a link member which is disposed so as not to hinder the operation of the link mechanism and has a slit, one side surface of which can retain a projection of the link mechanism. A second driving means imputs motion to the link member in the direction to move the link mechanism while said one side surface of the link member retains the projection of the link mechanism. The amount of operation of the link mechanism by the second driving means is set to be less than that by the first driving means.

A feed regulator of a sewing machine according to a second aspect of the present invention comprises a first driving means for swingably driving a feed regulating table by way of a link mechanism and a feed dog for switching the feed operating direction. The feed regulator of a sewing machine further comprises a feed regulating table supporting shaft which is incorporated in the feed regulating table and turnably supports the feed regulating table on a frame of the sewing machine. A feed regulating table supports a shaft crank which is fixed to the feed regulating table supporting shaft. An operating shaft crank which is turnably driven by the first driving means which is fixed to the frame of the sewing machine. A feed regulating table supporting shaft link is interposed between the feed regulating table supporting shaft crank and the operating shaft crank. A projection is defined in the feed regulating supporting shaft, the feed regulating table supporting shaft crank, or the operating shaft crank. A second driving means is fixed to the frame of the sewing machine. An eccentric cam is fixed to a forked crank which is turnable by the second driving means. The forked crank has a middle portion, which is turnably supported by the frame, one end defining forked portions for receiving the eccentric cam and another end connected to a link member. The link member has a slit one side of which is capable of retaining the projection thereby. The forked crank is turned for permitting one side surface of the link member to be retained by the projection so as to swing the feed regulating table supporting shaft.

A feed regulator of a sewing machine according to a third aspect of the present invention further comprises, in the feed regulator of a sewing machine of the second aspect of the present invention, first and second switches. The first switch issues a signal for operating the first driving means and the second switch issues a signal for operating the second driving means.

A feed regulator of a sewing machine according to a fourth aspect of the present invention further comprises, in the feed regulator of a sewing machine of the second aspect of the present invention, a selector switch for selecting the first driving means or the second driving means and a stepping pedal for operating the first or the second driving means.

PREFERRED EMBODIMENT OF THE PRESENT INVENTION

A feed regulator of a sewing machine according to a preferred embodiment of the present invention will be described with reference to FIGS. 1 to 4.

Figure 1:
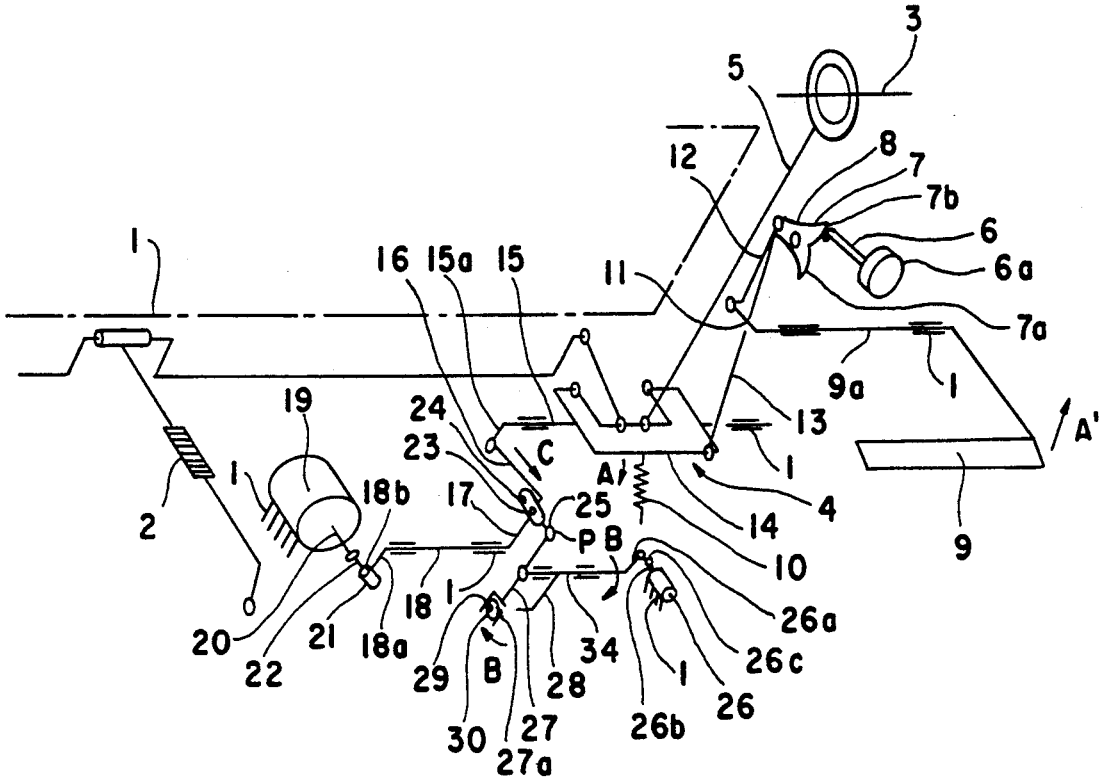
FIG. 1 is a perspective view of a feed mechanism of a sewing machine provided with a feed regulator according to a preferred embodiment of the present invention.
Figure 2:
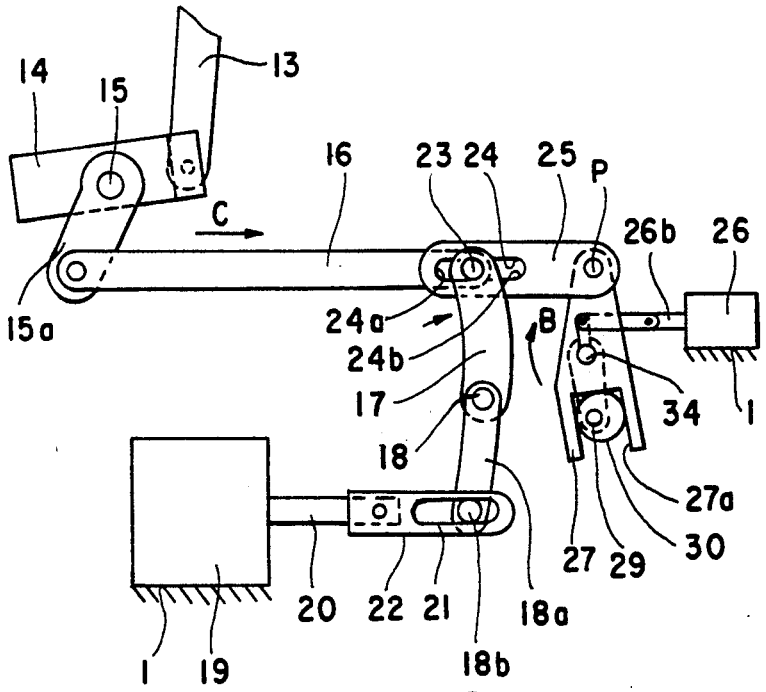
FIG. 2 is a front view showing first and second driving means and a feed regulating table of FIG. 1.
Figure 3:
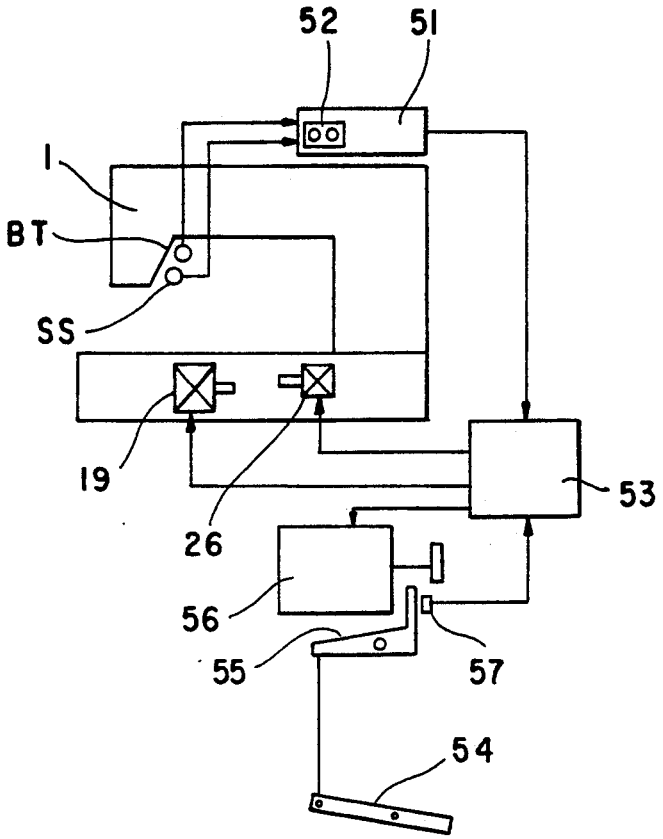
FIG. 3 is a schematic view showing an entire arrangement of the sewing machine of FIG. 1.

In FIGS. 1 to 3, designated at 1 is a frame. A reciprocal motion is applied to a feed dog 2 by a known feed mechanism, which is disposed at the lower portion of the frame, at the feed rate of the horizontal direction component. Designated at 3 is a main shaft. A known feed regulator 4 is composed of mainly a feed regulation table 14. The feed regulating table 14 is connected to the main shaft 3 by way of a crank rod 5. Designated at 6 is a feed regulating stud for regulating the feed rate. The stud has a feed regulating dial 6*a* provided at the rear portion thereof. When the feed regulating dial 6*a* is turned in normal direction or reverse direction, the tip end of the feed regulating stud 6 is moved to or away from the axial line thereof so that it is brought into contact with a forward directional cam surface 7*a* or a reverse directional cam shaft 7*b* of a feed regulating cam 7. The swinging rate of the feed regulating cam 7, which is turnable about a supporting shaft 8, can be increased or decreased.

A reverse stitching lever 9 has a base fixed to one end of a lever shaft 9*a* which is turnably supported by the frame 1. A feed regulating crank 11 is fixed to another end of the lever shaft 9*a*. The feed regulating crank 11 can be turned about the lever shaft 9*a* when the reverse stitching lever 9 is turned.

The feed regulating crank 11 and the feed regulating cam 7 are connected to each other by reverse stitching lever link 12 which is turnable at pins provided at both ends. Likewise, a pin connection if made between the feed regulating cam 7 and a feed regulating table 14 by feed regulating table link 13. The feed regulating table 14 is a U-shaped member turnably attached to the frame 1 and is always urged downward (the direction as denoted as arrow A) at one side thereof by a spring 10 which extends between the frame 1 and the feed regulating table 14. The feed regulating table 14 always urges the reverse stitching lever 9 upward (the direction as denoted A') by way of the feed regulating table link 13, the reverse stitching lever link 12 and the feed regulating crank 11.

The feed regulating table 14 is connected at one end to a first solenoid 19, which serves as a first driving means, by way of a known automatic reverse stitching link mechanism. The automatic reverse stitching link mechanism comprises, as shown in FIG. 2, a feed regulating table supporting shaft 15 which supports the feed regulating table 14 over the frame 1. A supporting shaft crank 15*a* protrudes from the feed regulating table supporting shaft 15. A feed regulating table supporting shaft link 16 is connected to the supporting shaft crank 15*a* by a pin. An operating shaft crank 17 is connected to the feed regulating table supporting link 16 by a hinge pin 23. An operating shaft 18 has one end fixed to the operating shaft crank 17 and a middle portion turnably supported by the frame 1. A first solenoid crank 18*a* is formed by bending another end of the operating shaft 18. A coupling member 22 has a slit 21 which slidably receives a pin 18*b* protruding from the end of the first solenoid crank 18*a*. A rod 20 of the first solenoid 19 is connected to the coupling member 22 by a pin. The length of the slit 21 is selected so as not to prevent the movement of the pin 18*b* accompanied by the swinging motion of the first solenoid crank 18*a* when the feed regulating table 14 is swung by the turning caused by stepping on the reverse stitching lever 9.

A feed regulator which is engaged and connected with the automatic reverse stitching link mechanism will be described hereinafter. The feed regulator mainly comprises a slit link 25 serving as a link member and a second solenoid 26 as a second driving means which is fixedly mounted on the frame 1. The slit link 25 has a feed regulating table supporting shaft link 16 and a slit 24 which engages with the hinge pin 23. The hinge pin 23 is connected to the operating shaft crank 17. The slit 24 has side surfaces 24*a* and 24*b*, which are confronted with each other so as not to prevent the movement of the hinge pin 23 when the first solenoid 19 is operated to start the reverse stitching operation. The slit link 25 is connected to the second solenoid 26 which moves the slit link 25 so as to minutely move the feed regulating table supporting shaft link 16. The other end of the slit link 25 is turnably connected to one end of a forked crank 27 by a pin P. The forked crank 27 has a middle portion in which one end of a supporting shaft 34, which is turnably supported by the frame 1, is engaged to turnably support the forked crank 27. The forked crank 27 has forked portion 27*a* at the other end thereof. It is possible to form a projection exclusively at the supporting crank 15*a*, the feed regulating supporting shaft link 16 or the operating shaft crank 17 instead of the hinge pin 23 which is received by the slit 24.

The supporting shaft 34, at the middle portion thereof, is fixed to one end of an L-shaped crank 28. The L-shaped crank 28 is fixed, at the other end thereof, to an eccentric cam 30 by a single set screw 29. The eccentric cam 30 can be turned around the set screw 29 and fixed to the set screw 29 at the arbitrary position of the circumferential direction thereof. The eccentric cam 30 is engaged in the forked portions 27*a* of the forked crank 27 so as to be movable relative thereto. The second solenoid crank 26*a*, which is fixed to the other end of the supporting shaft 34, has a tip end. A rod 26*b* of the second solenoid 26 for controlling the feed rate is connected by a pin to the tip end by way of a swinging link 26*c*. When the rod 26*b* of the solenoid 26 is moved forwardly, namely, moved toward the second solenoid 26 so as to engage therein, the supporting shaft 34 and the crank 28 is turnably driven by way of the swinging link 26*c* and the second solenoid 26*a*. The forked crank 27 is turned around the supporting shaft 34 by the eccentric cam 30, which is engaged in the forked portions arrow B as illustrated in FIG. 1. After one side surface 24a is retained by the hinge pin 23, a minute motion is given to the feed regulating table supporting shaft link 16 by way of the slit link 25. The minute motion to be given to the feed regulating table supporting shaft link 16 is carried out to obtain seam lengths which are shorter than those which are obtained by the operation of the cam surface 7a or 7b of the feed regulating cam 7.

In FIG. 3, a control circuit 5 is used to issue a signal instructing an automatic stitching operation which is made based on a predetermined program. The control circuit 53 is disposed under a table of the sewing machine, not shown, and has therein a driving circuit for driving the first solenoid 19 and the second solenoid 26. An operating panel 51 is fixed to the frame 1 and has a selector switch 52. A changeover signal issued by the selector switch 52 is supplied to the control circuit 53. The selector switch 52 selectively switches over the first solenoid 19 or the second solenoid 26. The first solenoid 19 and the second solenoid 26 are not operated merely by reception of the changeover signal issued by the selector switch 52 but are operated by reception of the changeover signal and a stepping signal which is issued by a stepping pedal 54, described later.

Designated at BT and SS are push buttons serving as switches disposed at the front surface of the frame 1. Signals issued by operating the push button BT and SS are supplied to the control circuit 53 by way of the operating panel 51 so that the operator can arbitrarily operate the first solenoid 19 or the second solenoid 26. That is, the push button BT as the first switch is pressed when the reverse stitching operation is performed at the same seam length as the forward stitching operation while the press button SS as the second switch is pressed when the reverse stitching operation, or a stopper stitching operation or a reinforcing stitching operation is performed at the arbitrarily set minute seam length. Any of the push buttons BT or SS can operate preferentially the rod 20 of the first solenoid 19 or the rod 26a of the second solenoid 26 irrespective of the changeover position of the selector switch 52 on the operating panel 51. That is, the push button BT issues a signal for forwardly operating the first solenoid 19 when it is pressed arbitrarily while the push button SS issues a signal for forwardly operating the second solenoid 26 when it is pressed irrespective of the automatic stitching program, whereby the stitching operation such as the reverse stitching is carried out.

A stepping pedal 54 is mounted on a stand of the sewing machine, not shown. When the operator steps on the stepping pedal 54, a clutch operating lever 55 is swung so that a signal issued by an operating switch 57 is supplied to the control circuit 53, thereby rotating a motor 56 for driving the main shaft 3. When the reverse stitching operation is performed, the clutch operating lever 55 is swung so that a signal issued by the operating switch 57 is supplied to the control circuit 53 so that the first solenoid 19 or the second solenoid 26 is operated depending on the changeover position of the selector switch 52, thereby performing the stitching operation. The operating switch 57 detects a stepping position of the stepping pedal 54 or the reverse stitching position.

An operation of the feed regulator according to the present invention will be described hereinafter.

The automatic reverse stitching operation which is the same as the conventional sewing machine will be described first. The selector switch 52 is steps on the stepping pedal 54, which is detected by the operating switch 57 so that the automatic stitching operation can be performed in accordance with the automatic stitching program which is previously stored in the control circuit 53. That is, the motor 56 is driven, upon reception of the signal from the control circuit 53, whereby the forward stitching operation is started by the feed means on the basis of the feed rate which is determined by the feed regulating stud 6 and the feed regulating cam 7. When the forward stitching is performed for predetermined seam lengths which is stored in the control circuit 53, a solenoid driving signal issued by the control circuit 53 is supplied to the first solenoid 19 so that the rod 20 is moved forwardly, namely, moved toward the first solenoid 19, thereby imparting a drawing operation to the first solenoid crank 18a by way of the coupling member 22. Accordingly, the operating crank 17 fixed to the operating shaft 18 is turned so that the supporting shaft crank 15a is turned by way of the feed regulating table supporting shaft link 16, whereby the feed regulating table 14 is turned in the direction opposite to the arrow A. Consequently, the feed operating direction is changed from the forward stitching direction to the reverse stitching direction.

After the stitching operation is performed for the interval corresponding to the seam length, the rod 20 of the first solenoid 19 is returned upon reception of the signal issued by the control circuit 53 so that the regulating table 14 also is returned upon reception of the resilient force of the spring 10, whereby the forward stitching operation is performed. When the cloth is stitched at the end portion thereof and the stepping pedal 54 is operated so as to perform the reverse stitching operation, which is detected by the operating switch 57, the rod 20 of the first solenoid 19 is moved forwardly on the basis of a signal issued by the control circuit 53. The feed operation direction is changed from the forward stitching operation to the reverse stitching operation. As a result, the stitching operation is stopped at the rear end of the stitching cloth. The seam length in the reverse stitching operation can be set to be the seam length in the forward stitching operation since the inclination of the feed regulating table 14 is restricted by the cam surface 7b at the reverse stitching side. This side is confronted with the cam surface 7a at the forward stitching side of the feed regulating cam 7. That is, in the conventional automatic reverse stitching unit, only the reverse stitching having the same seam length obtained in the forward stitching operation is obtained.

The case where the feed regulator of the sewing machine when the second solenoid 26 is operated will be described.

When the operator steps on the stepping pedal 54 after the selector switch 52 is switched over, which is detected by the operating switch 57, the automatic stitching is performed in accordance with the automatic stitching program which is stored in the control circuit 53. The motor 56 is driven upon reception of the signal issued by the control circuit 53 and the rod 26b of the second solenoid 26 moved forwardly, i.e. toward the second solenoid 26, so that the supporting shaft 34 and the crank 28 are turnably driven in the direction of the arrow B by way of the swinging link 26c and the second solenoid crank 26a. The forked crank 27, which is connected to the supporting shaft 34 by a pin, is turnably driven by the eccentric cam 30, which is engaged with the forked portions 27a, in the direction of the arrow B.

Figure 4:
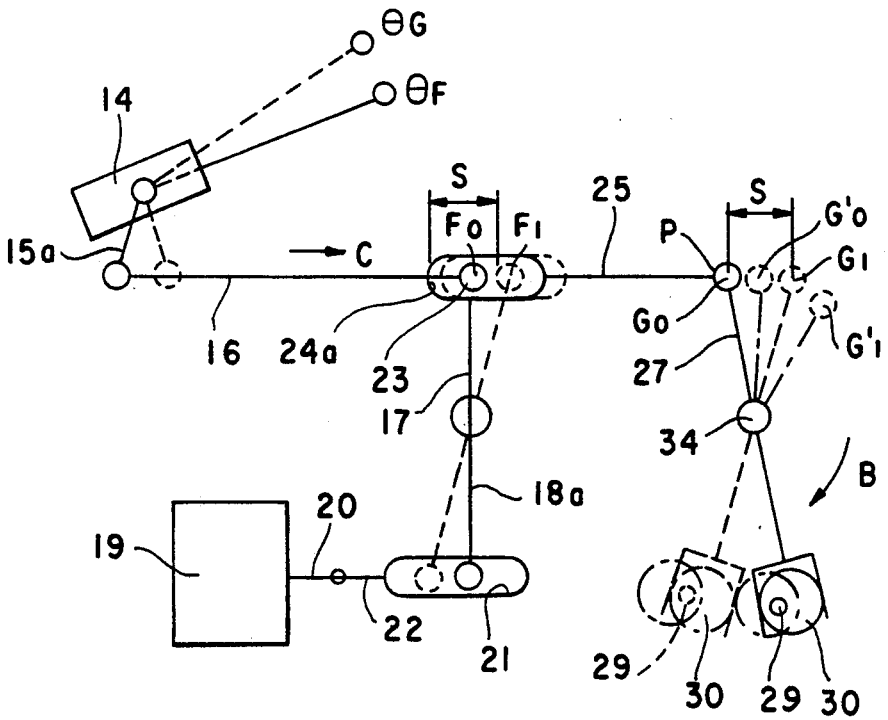
FIG. 4 is a view showing an operation of the feed regulator of FIG. 1.
Figure 5:
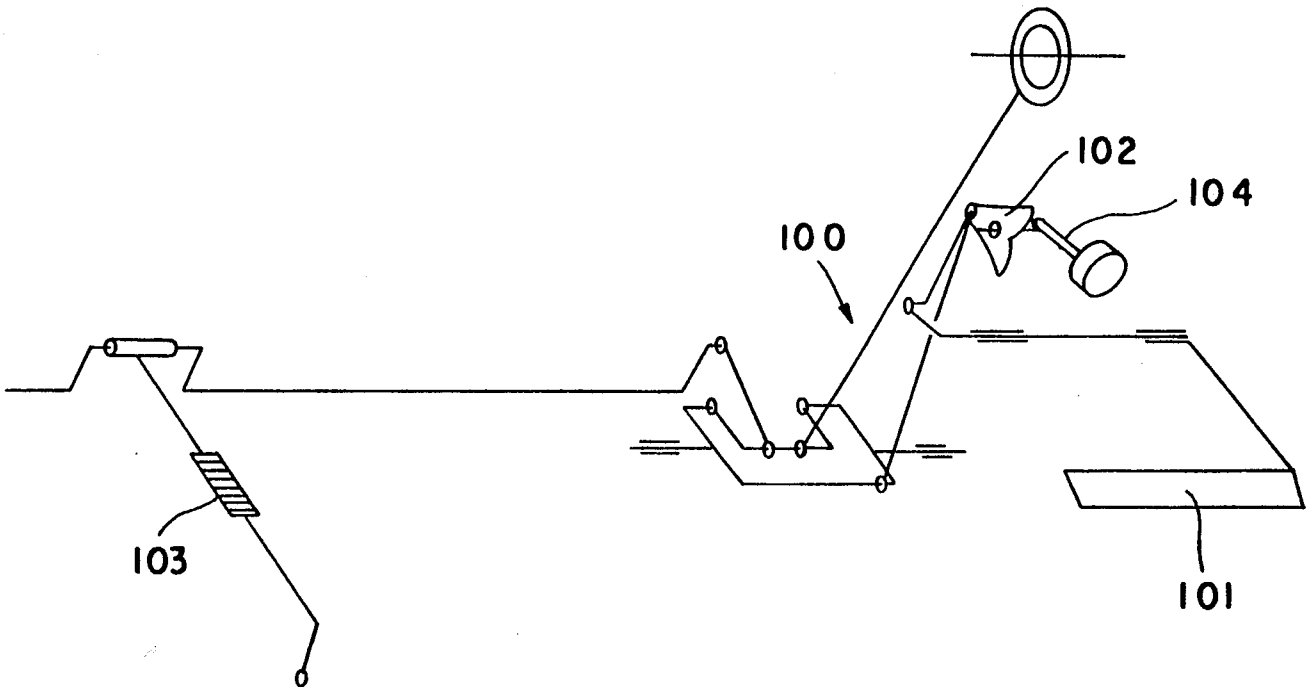
FIG. 5 is a perspective view showing a prior art feed mechanism of a conventional sewing machine.
Figure 6:
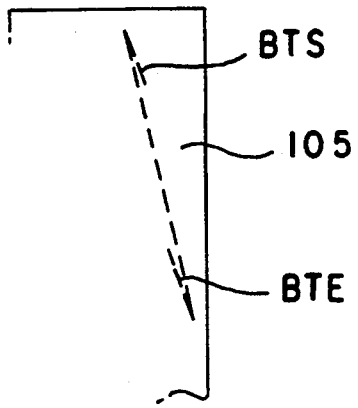
FIG. 6 is a view showing a seam at a dart portion which is stitched according to the conventional sewing machine of FIG. 5.
Figure 7:
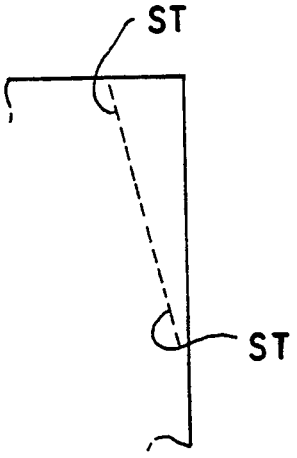
FIG. 7 is a view showing another seam at a dart portion which is stitched according to the conventional machine of FIG. 5.

With such an arrangement, one side surface 24a of the slit 24 of the slit link 25 connected to the other end of the forked crank 27 is retained by hinge pin 23. The feed regulating supporting shaft link 16 is driven in the direction of the arrow C. Accordingly, the supporting shaft crank 15*a* is turned so that the feed regulating table 14 is inclined against the resilience force of the spring 10. Consequently, the stitching operation is performed in accordance with the seam length corresponding to the amount of inclination. The inclination angles OF and OG of the feed regulating table 14, as illustrated in FIG. 4, are obtained by turning the hinge pin 23, thereby moving the feed regulating table supporting shaft link 16 when one side surface 24*a* of the slit 24 turns the hinge pin 23 about the operating shaft 18 after it contacts the hinge pin 23. The moving range in the horizontal direction of the slit link 25 is S.

When the rod 26*a* of the second solenoid 26 is moved forwardly, while the eccentric cam 30 is engaged in the forked portions 27*a* of the forked crank 27 at the position as illustrated in a solid line in FIG. 4, a fulcrum P where the slit link 25 and the forked crank 27 are connected to each other moves from G0 to G1 for the length S. The slit link 25 then moves for the length S. As a result, the hinge pin 23 retained by one surface 24*a* of the slit hole 24 moves from F0 to F1 so that the feed regulating table supporting shaft link 16 moves in the direction of the arrow C, whereby the supporting crank 15*a* is turned so as to move the turning position of the feed regulating table 14 is moved from OF to OG.

If the position where the eccentric cam is engaged in the forked portion 27*a* of the forked crank 27 at the position as illustrated in dotted lines in FIG. 4, the fulcrum P is moved to the G0′ and the fulcrum G0′ moves to G1′ at the time of forward movement of the second solenoid 26 so that one side surface 24*a* of the slit 24 moves to a large extent in the direction of C. As a result, the inclination angle of the feed regulating that one side surface 24*a* of the slit 24 moves to a large extent in the direction of C. As a result, the inclination angle of the feed regulating table 14 can be increased to a large extent. As mentioned above, it is possible to arbitrarily regulate the inclination angle of the feed regulating table 14 by varying the position where the eccentric cam 30 is engaged in the forked portions 27*a* along the circumferential direction thereof.

If the components of the eccentric cam 30, etc. are regulated so that the position G1 of the pin P reaches 1.5 mm and the position G1′ of the pin P reaches −1.5 mm respectively at the forward stitching operation, it is possible to set selectively the seam length to range from 1.5 mm to −1.5 mm when the second solenoid 26 moves forward to perform the reverse stitching operation, the stopper stitching operation or the reinforcing stitching operation at the short seam length irrespective of the seam length which is restricted by the feed regulating stud 6.

Figure 8:
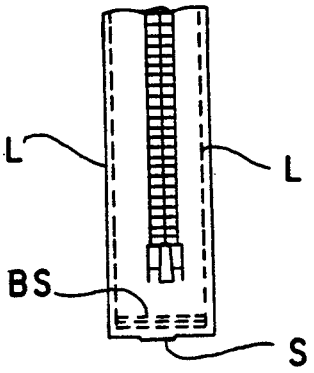
FIG. 8 is a view showing another seam defined at a portion where a fastener is stitched according to the conventional machine of FIG. 5.

When the second solenoid 26 is operated to return upon reception of the signal issued by the control circuit 53 after the reverse stitching operation or the stopper stitching operation in short seam lengths is completed, the feed regulating table 14 returns to the original position by the resilience force of the spring 10. The forward stitching operation is performed in the seam length which is given by the swinging rate of the feed regulating cam 7. When the operator steps on the stepping pedal 54 at the stitching ending end, which is detected by the operating switch 57, the second solenoid 26 moves forward upon reception of the signal issued by the control circuit 53, the stitching operation is switched to the reverse stitching operation or the stopper stitching operation in short seam lengths whereby the stitching operation can be performed for the predetermined seam lengths. The reinforcing stitching operation can be made in short seam length by the forward operation of the second solenoid 26 and the short side S of the cloth in FIG. 8 can be stitched.

Operation of the push button BT and SS, which are disposed at the front surface of the frame 1, will be described hereinafter.

When the push button BT is pressed as shown in FIG. 3, the first solenoid 19 is preferentially moved forward. Irrespective of the automatic stitching program and the changeover position of the selector switch 52, the reverse stitching operation can be made in the same seam length as the forward stitching operation. When the other push button SS is pressed, the second solenoid 26 is preferentially moved forward irrespective the automatic stitching program and the changeover position of the selector switch 52, thereby performing the reverse stitching operation or the stopper stitching operation or the reinforcing operation in the arbitrary set minute feed rate which is given by the position where eccentric cam 30 is engaged in the forked portions 27*a*.

In the embodiment set forth above, the rod 26*b* of the second solenoid is moved forward so that the supporting shaft 34 and the crank 28 are turnably driven by way of the swinging link 26*c* and the second solenoid crank 26*a*. It is possible to adopt a rotary solenoid which directly turnably drives the supporting shaft 34 instead of the second solenoid 26. In this case, the swinging link 26*c* and the second solenoid crank 26*a* can be omitted.

As is evident from the explanation set forth above, it is possible to perform the stitching operation by driving the first driving means in the same seam length as the seam length in the conventional automatic reverse stitching mechanism at the stitching starting end or the 1 stitching ending end where the reverse stitching is performed. Additionally, it is also possible to perform the stitching operation by driving the second driving means. Furthermore, it is possible to perform the forward reinforcing stitching operation in short seam length. The reverse stitching operation, the stopper stitching operation or the reinforcing operation can be performed safely and in a stable manner by the second driving means in the seam length which is different from that performed by the first driving means without keeping the reverse stitching lever at the middle position thereof, which results in rationalizing the stitching operation. Furthermore, it is possible to perform the reverse stitching, the stopper stitching operation and the reinforcing operation in the arbitrary seam length by adopting the eccentric cam for setting the seam length.

Still furthermore, it is possible to perform voluntarily the reverse stitching operation, the stopper stitching operation or the reinforcing operation by forcibly driving the first or the second driving means by pressing the first or the second press button.

Still furthermore, it is possible to perform the reverse stitching operation, the stopper stitching operation or the reinforcing operation with ease in response to the stepping operation of the stepping pedal after the selector switch is switched over by provision of the selector switch which selects the first or the second driving means and the stepping pedal which selectively operates the first or the second driving means based on the signal issued by the selector switch.

What is claimed is:

1. A feed regulator of a sewing machine including a first driving means for swingably driving a feed regulating table by way of a link mechanism and a feed dog for switching a direction of feed of said machine, the first driving means and the table being supported on a frame of the machine, said regulator comprising:

a feed regulating shaft mounted in the table for turnably supporting the table on the frame;

a first crank secured to said feed regulating shaft;

a second crank which is rotatably driven by the first driving means;

a link for said feed regulating shaft which is interposed between said second crank and said first crank to transmit rotation of the second crank to the first crank;

a link member having a slit with first and second opposite side surfaces;

a third crank connected between said second crank and said link member; said third crank having a projection for engaging said first or second opposite side surfaces of said slit;

second driving means supported on the machine frame;

an eccentric cam turnable by the second driving means; and a fourth crank having a middle portion turnably supported on the machine frame, the fourth crank having one end which is forked, the forked end being engaged by said cam, the fourth crank having another end connected to said link member, the third crank being turned to swing said feed regulating shaft via the link member, the link and the first crank.

2. A feed regulator of a sewing machine according to claim 1, further comprising first and second switches, said first switch issuing a signal for operating the first driving means and the second switch issuing a signal for operating the second driving means.

3. A feed regulator of a sewing machine according to claim 1, further comprising a selector switch for selecting the first driving means or the second driving means and a stepping pedal for operating the first or the second driving means.

* * * * *